United States Patent [19]

Jones

[11] 3,939,527

[45] Feb. 24, 1976

[54] PORTABLE SURFACE CLEANER

[75] Inventor: Terry H. Jones, Norman, Okla.

[73] Assignee: Clarke-Gravely Corporation, Muskegon, Mich.

[22] Filed: Oct. 12, 1973

[21] Appl. No.: 405,819

[52] U.S. Cl. ..... 15/353; 15/320; 15/321

[51] Int. Cl.[2] ..... A47L 7/00

[58] Field of Search ..... 15/320, 321, 322, 353

[56] References Cited

UNITED STATES PATENTS

| | | | |
|---|---|---|---|
| 2,635,277 | 4/1953 | Belknap | 15/353 X |
| 2,671,915 | 3/1954 | Fraser et al. | 15/353 X |
| 2,726,807 | 12/1955 | Lewis | 15/320 X |
| 2,867,231 | 1/1959 | Gerstmann | 15/353 X |
| 3,663,985 | 5/1972 | Burgoon | 15/353 |
| 3,747,155 | 7/1973 | Koellisch | 15/321 X |
| 3,774,260 | 11/1973 | Emus, Jr. | 15/321 |

*Primary Examiner*—Harvey C. Hornsby
*Attorney, Agent, or Firm*—Price, Heneveld, Huizenga & Cooper

[57] ABSTRACT

A surface cleaning apparatus having a molded plastic housing and an upwardly and rearwardly projecting casing terminating at a handle. The lower portion of the housing includes a forward suction nozzle with an opening into a recovery tank and a molded plastic cover hingedly mounted over the recovery tank. The cover includes a downwardly projecting baffle adjacent the suction nozzle opening into the recovery tank. Suction is generated by a blower at the rear of the recovery chamber and a shield positioned in front of the blower prevents liquid flow from the recovery chamber into the blower. The cover includes a raised portion extending out over the top of the shield and downwardly to a juncture with the forward baffle, the raised portion thereby defining a passageway around and over the shield whereby air is free to flow from the recovery chamber over the shield and into the blower. Liquid in the recovery chamber is pumped out through one compartment of a dual-compartment hose which empties into a remote drain. The other compartment of the dual-compartment hose is connected to a faucet such that clean water is fed to a set of spray nozzles located in the apparatus just behind the suction nozzle. The upwardly projecting control casing includes a well molded thereinto into which a solution bottle can be inverted and joined by a syphon line to the clean water line whereby the detergent solution can be introduced into the cleaning fluid as it is sprayed onto a carpet to be cleaned.

8 Claims, 9 Drawing Figures

PORTABLE SURFACE CLEANER

CROSS REFERENCE TO RELATED APPLICATIONS

U.S. patent application Ser. No. 158,357 filed June 30, 1971 and assigned to Clarke-Gravely Corporation, relates to the general field of the present invention and teaches SURFACE CLEANING APPARATUS. U.S. patent application Ser. No. 352,623, filed Apr. 19, 1973, and assigned to Clarke-Gravely Corporation, is the continuation of U.S. patent application Ser. No. 158,357 and teaches SURFACE CLEANING APPARATUS.

BACKGROUND OF THE INVENTION

The present invention relates to surface cleaning apparatus, and particularly to apparatus for cleaning carpets. One of the more popular types of carpet cleaners utilized today are the steam cleaners. These devices employ a carriage upon which a large clean water tank and a large recovery tank are mounted. The two tanks are joined by separate hoses to a carpet tool. A clean water hose joins the clean water tank to a spray nozzle positioned on the tool and a return water hose extends from a suction nozzle to the recovery tank. A large blower or impeller on the recovery tank generates suction whereby water sprayed onto the carpet is drawn into the recovery tank.

Such devices are quite bulky and cumbersome to transport. Further, the clean water tank must be repeatedly filled and the dirty water tank must be repeatedly emptied. Because of the distance between the blower or impeller which is mounted on the recovery tank and the suction nozzle, a very high powered blower is required in order to generate enough suction to remove all excess water from the carpet.

In order to place the blower in closer proximity to the suction nozzle and thereby effect a more efficient suction, some prior teachings suggest mounting the impeller and the suction nozzle on a common housing or chassis. The recovery tank and the clean water tank may also be mounted on the same housing. With the tanks mounted on the same housing, the apparatus is extremely bulky and difficult to move around. With the blower mounted in closer proximity to the suction nozzle, there is a tendency for suds and liquid to be drawn into the blower. one device employs a long and torturous passageway from the suction nozzle to the blower in an attempt to obviate this difficulty. However, this dilutes the effectiveness of the suction.

The same device employs an intermediate recovery chamber along the suction path, with returned cleaning solution being pumped from this intermediate recovery chamber to the ultimate recovery tank. This creates yet another problem in the prior art device in that dirty water tends to clog either the pump or the filter employed to prevent clogging of the pump.

Yet another prior art device teaches the elimination of tanks altogether by joining the suction nozzle to a conduit which empties ultimately into a drain. Similarly, the spray nozzles are joined by a conduit to a faucet. However, the employment of a remote blower as a source of suction leaves one faced with the problem of acquiring an efficient suction at the nozzle. Also, the employment of a blower mounted on a common chassis with the suction nozzle leaves one with the problem of preventing suds and liquid from being drawn into the blower. Further, the separate hoses employed tend to be cumbersome and difficult to work with. Finally, it is difficult to utilize soap in connection with the clean water source since the water and soap solution cannot be premixed. Thus, it becomes difficult to locate the detergent solution source on the apparatus in such a way that it is not in an inconvenient location.

SUMMARY OF THE INVENNTION

The present invention comprises an extremely compact and portable surface cleaning apparatus in which the suction creating blower and the suction nozzle are mounted on a common chassis or housing with a small recovery tank therebetween. A baffle is positioned at the top of the recovery tank generally adjacent the opening of the suction nozzle into the recovery tank. This baffle deflects incoming water and air downwardly towards the bottom of the recovery tank and thereby minimizes the chances of suds and liquid being drawn into the blower which is positioned generally at the rear of the recovery tank and which is in flow communication therewith through a passageway located generally at the rear of the recovery tank.

Preferably, a shield extends upwardly from the bottom of the recovery tank toward the top thereof, generally in front of the blower and spaced therefrom. A baffle arches outwardly over and downwadly around the top of the shield to define the passageway at the rear of the chambers through which air is drawn. This passageway is preferably smaller in flow area than either the recovery chamber or the space between the shield and the blower means. This further minimizes the chances of suds or liquid being drawn into the blower means. It is further preferable that the first baffle and the second baffle which extends outwardly over the top of the shield are integrally formed as part of the molded plastic cover which is hingedly mounted to the housing at the top of the recovery chamber.

The employment of bulky solution and recovery tanks is avoided in the present invention by joining the spray nozzles on the device to a remote source of liquid such as a faucet and by pumping returned liquid from the recovery chamber directly to a remote drain. The need for separate difficult-to-handle hoses is eliminated by the employment of a single compartmentalized hose in which a first compartment joins the source of water to the spray nozzles and a second compartment joins the pump to the drain.

The introduction of detergent solution into this system is effected by providing a well at a convenient point in an upper surface of the apparatus housing. The soap solution bottle is merely inverted and seated in the well. A hole in the bottom of the well is joined by a syphon line to the clean water line which extends from the faucet to the spray nozzles. This serves not only to locate the solution bottle at a convenient location, but also provides an extremely quick and easy means for operably joining the solution bottle to the syphon line.

The problems of clogging which might otherwise be encountered in the pump which pumps liquid from the recovery chamber to the drain is obviated by the employment of a large area filter which is coterminous with the side walls of the recovery chamber and which is positioned at a point spaced above the floor of the recovery chamber and above the opening through which dirty solution is drawn by the pump. The large area filter clogs far less easily than would conventional filters which might be placed directly over the opening through which liquid is drawn.

These and other objects and advantages of the present invention will be more fully understood and appreciated by reference to the written specification and appended drawings.

DESCRIPTION OF THE PREFERRED EMBODIMENT

Figure 1:
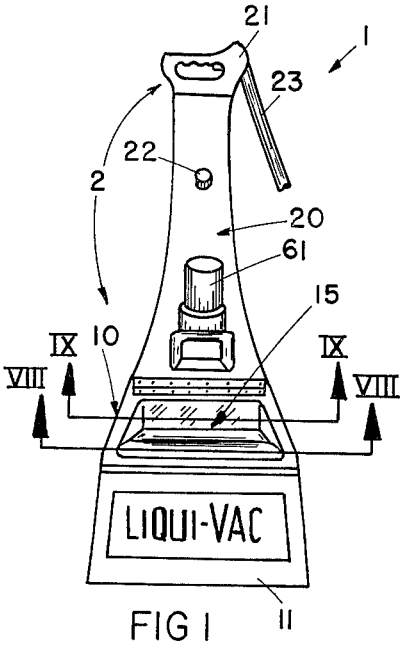
FIG. 1 is an elevational front view of the cleaner.
Figure 2:
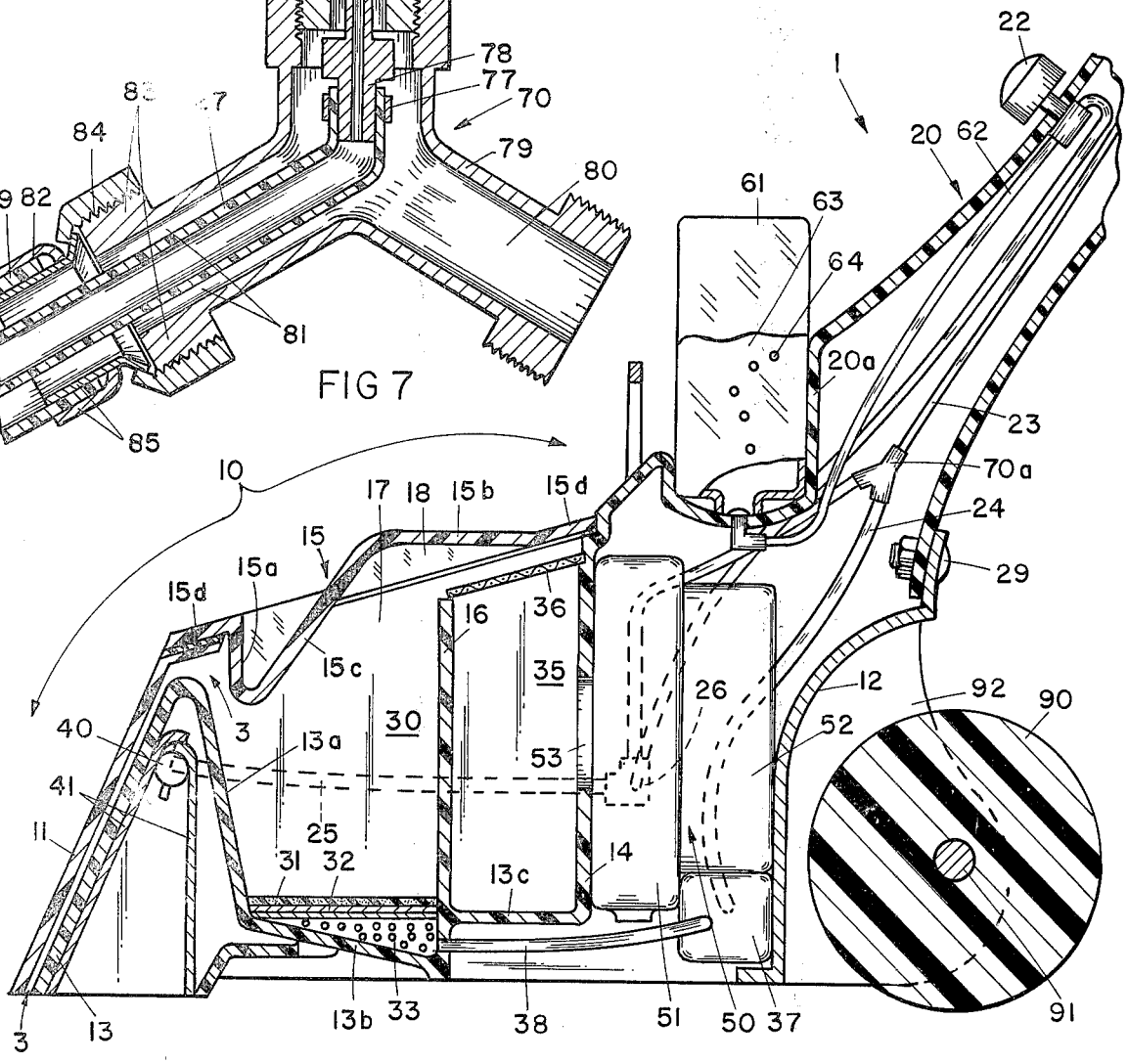
FIG. 2 is a vertical cross-sectional view of the cleaner taken approximately along the center of the cleaner.

In the preferred embodiment, the cleaning machine 1 comprises a molded plastic housing 2 including a lower housing portion 10 and an upwardly and rearwardly projecting control casing 20 which terminates at a handle 21 (FIG. 1). The lower housing or chassis 10 includes a forward suction nozzle 3 which opens into a recovery chamber 30 (FIG. 2). A molded plastic cover 15 hingedly mounted to housing 10 at the top of recovery chamber 30 includes a forward, downwardly projecting baffle 15*a* located adjacent the opening of suction nozzle 3 into recovery chamber 30. Baffle 15*a* deflects dirty cleaning solution downwardly as it enters recovery chamber 30. Suction is generated by a blower 50 located at the rear of recovery chamber 30. A shield 16 extends upwardly from the floor of recovery chamber 30 generally to the top thereof in order to prevent suds and water from being drawn into blower 50.

Figure 6:
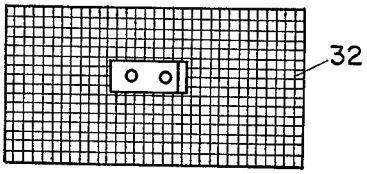
FIG. 6 is a front view of the supply and discharge tubing interconnected to a plumbing fixture system by means of a fixture connector.
Figure 6:
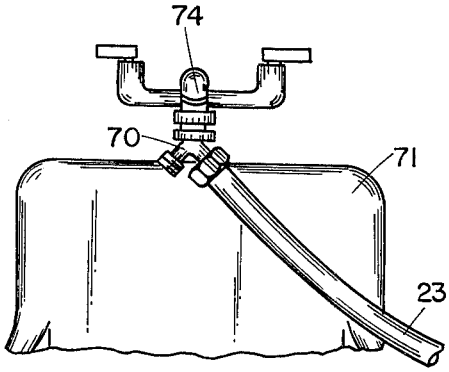

A compartmentalized tubing 23 is attached to a plumbing fixture 74 by means of a "Y" connector 70 (FIG. 6). The compartmentalized tubing 23 provides a means for carrying cleaning fluid, i.e., water, to the spray nozzle 40 located rearwardly of the suction nozzle 3 (FIG. 2). A pump 37 is used to remove used cleaning fluid from recovery chamber 30. The pump outlet is connected to the compartmentalized tubing 23 which discharges the used cleaning fluid into the sink 71 associated with the plumbing fixture 74 (FIG. 6).

An additive dispenser 61 is mounted on chassis 10 and supplies additive to the cleaning fluid which is applied to the surface being cleaned from spray nozzle 40. The additive container 61 is held on the upper housing in a well 20*a* which is molded into the surface cleaner 1. A syphon tubing 62 runs through the control casing 20 to a flow adjustment valve 22 which governs flow of the additive into the cleaning fluid supply tubing 25. A large area filter and screen system, 31 and 32, is placed at the bottom of recovery chamber 30 to filter the used cleaning fluid which is evacuated from the recovery chamber by means of pump 37.

Referring to FIGS. 1 and 2 molded plastic housing 2 comprises lower housing 10 which is substantially rectangular having an open bottom, a forwardly and downwardly inclined front wall 11, a vertical back wall 12 joined to vertical side walls 17. A cylindrical tube-like roller 90 having closed ends is journaled by a tubular axle 91 extending traversely through the rear support flanges 92 which extend rearwardly from rear wall 12. Roller 90 is adjacent to the rear wall 12 so that a peripheral portion of the roller 90 projects downwardly beyond the horizontal lower limit of the housing side walls for supporting the rearward portion of the housing in spaced relation above the surface being cleaned. The advantage of using a cylindrical roller 90 is that it distributes the mass of the cleaner over a larger area than caster wheels or the like, when being moved across a carpet-like surface. Further, the cleaner may be moved up or down stairs wherein the exposed peripheral portion of the roller 90 permits the roller to contact and follow the surface of the riser and upper surface of stair treads as it is moved up or down stairwells. When in an "at rest" position, the cleaner is supported by the roller 90 and the front wall 11.

The housing 10 is provided with a transverse first partition 13 positioned in selected space relation parallel with and rearwardly of the front wall 11 (FIG. 2.). The depending edge of the first partition 13 lies in the plane defined by the depending edges of the side walls and front wall while its upper limit is less in a horizontal plane than the height of the front wall 11, thus forming a suction nozzle 3 extending between the side walls 17. The front wall 13*a* of recovery chamber 30 extends from the top of first partition 13 vertically away from the top of the housing to the lower part of the housing. The bottom wall 13*b* of recovery chamber 30 slopes rearwardly and gradually downwardly therefrom. Shield 16 extends upwardly from bottom wall 13*b* between side walls 17 generally to the top of recovery chamber 30 to prevent suds and water from flowing into blower 50. A continuation 13c of bottom wall 13b extends rearwardly a short distance from shield 16, on a plane above the level of the rear of bottom wall 13b.

A second partition 14 extends upwardly from the rear of continuation wall 13c between side walls 17 and divides the lower housing 10 into the forward recovery section and a rearward equipment section. The equipment section is closed at its rear by a metal plate 12 fastened to the rear bottom edge of casing 20. Blower means 50, comprising an impeller 51 driven by motor 52 is positioned within the housing with impeller 51 closely adjacent and behind the second partition 14. An opening 53 is provided in partition 14 whereby blower 50 draws air therethrough. The shield 16 which protects blower 50 terminates, at its upper horizontal limit, in downwardly spaced relation with respect to the plane of the top cover 15 that position to define a passageway 18 over the top of shield 16. Shield 16 is positioned in parallel spaced relation forwardly of the vertical second partition 14 to form an air compartment 35 communicating with the blower opening 53. A screen 36 extends between the upper limits of the shield 16 and the second partition 14 defining the opening of the air compartment 35 and acts to exclude contaminants from air compartment 35. The shield 16 and screen 36 also act to inhibit flow of used cleaning fluid (and its associated foam) into air compartment 35.

Recovery chamber 30 is very small and compact. It is approximately 4 and ¼ inches deep at the front. Shield 16 is approximately 6 to 7 inches tall. Recovery chamber 30 is approximately 9 to 10 inches wide from side to side. At its bottom, it is approximately 3 and ½ inches from front to back and at its top, is approximately 5 to 6 inches from front to back. Thus, the direct line distance between the opening of nozzle 3 in the recovery chamber 30 and the top of shield 16 is only about 6 inches. This extremely compact construction results in blower 50 being extremely effective in drawing air and water through suction nozzle 3. Yet, air and water separation is efficiently effected even in this very compact space as a result of the unique baffle arrangement of the present invention.

Lower housing 10 is covered by a molded plastic top cover 15 which is hingedly mounted to the lower housing 10 above second partition 14 (FIGS. 1 and 2). Cover 15 is trimmed by a flat border 15*d* (FIGS. 2, 8 and 9) which seats on the top edges of front wall 11, side walls 17, and second partition 14. Integrally fromed into cover 15 is a downwardly projecting forward baffle 15a spaced in close proximity to the opening of suction nozzle 3 where it enters recovery chamber 30. Baffle 15a causes an abrupt downward flow of air and used cleaning fluid into the chamber and helps separate air from the cleaning fluid. Cover 15 includes a raised portion over the top of shield 16 formed by a wall 15*c* sloping upwardly and rearwardly from the bottom of baffle 15*a* and by a generally horizontal surface 15*b* which blends back into border 15*d*. The surfaces 15*b* and 15*c* serve as a baffle arching outwardly and downwardly over shield 16 to create a passageway 18 of gradually diminishing flow area around and over shield 16 which channels air flow into air compartment 35 further aiding efficient separation of cleaning fluid and air. At its narrowest point, this passageway 18 is lesser in flow area than recovery chamber 30 or air compartment 35. The top cover 15 is transparent so as to enable the cleaner operator to monitor the cleaner's internal workings.

A spray nozzle 40 is mounted below the upper part of first partition 13 and is suspended thereat by support brackets 41. Nozzle 40 applies a spray of cleaning fluid coextensive with the transverse distance between the side walls 17.

Figure 5:
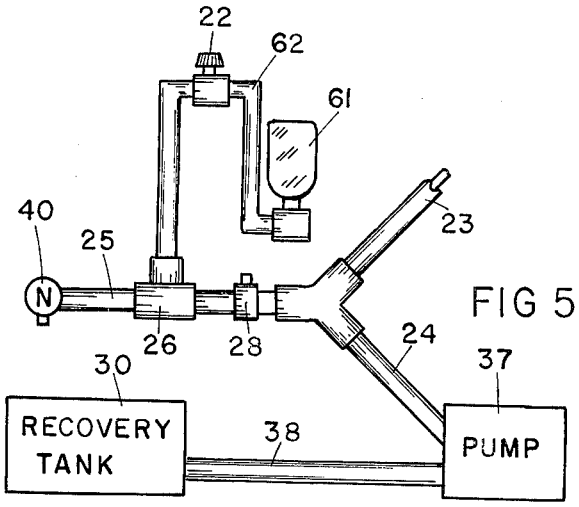
FIG. 5 is a schematic diagram of the cleaning fluid supply and discharge system.

As shown in FIGS. 1, 2, and 5, means for supplying additive is provided by container 61 which is mounted into a holder well 20*a* where control casing 20 contacts lower housing 10. Well 20*a* is a recess or depression integrally molded into the upper surface of control casing 20. Container 61 supplies additive through tubing 62 which runs from a hole in the bottom of well 20*a* through the control casing 20 to adjustment valve 22 and thereafter into injector 26. At injector 26, the additive is dispersed into supply tubing 25 which supplies nozzle 40. The hole in the bottom of well 20*a* is covered by a screen 24*a* to minimize contaminant flow to injector 26.

Figure 8:
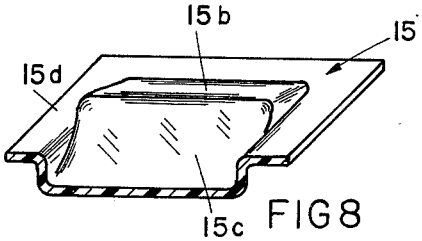
FIG. 8 is a cut-away view of the top cover contoured baffle cut away along reference line VIII of FIG. 1.
Figure 9:
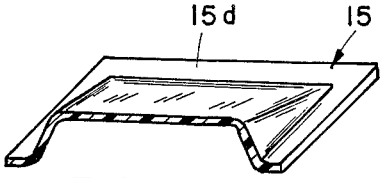
FIG. 9 is a cut-away view of the top cover contoured baffle cut away along reference line IX of FIG. 1.
Figure 7:
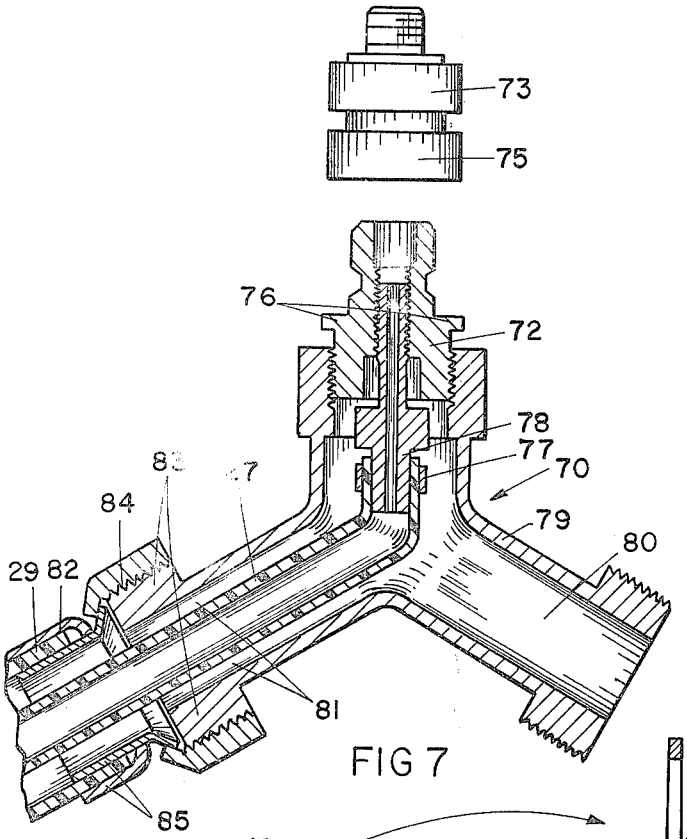
FIG. 7 is a vertical cross-sectional view of the fixture connector shown in FIG. 6.

An elongated length of flexible supply tubing 25 is connected at one end with spray nozzle 40 and at the other end with compartmentalized tubing 23 which is connected to plumbing fixture 74 (shown in FIGS. 7 and 8).

A fluid pump 37 is mounted against rear plate 12 below and to one side of motor 52 (shown in FIG. 2 and schematic FIG. 5). The intake port of the pump 37 is connected to pump supply tube 38 which extends through second partition 14 and communicates with used cleaning fluid chamber 30. The output port of the pump 37 is connected to discharge tubing 24 which extends through the housing 10 and is connected to compartmentalized tubing 23. As seen in FIG. 6, compartmentalized tubing 23 is connected to plumbing fixture 74 whose associated sink 71 provides a drain for discharged used cleaning fluid.

Figure 3:
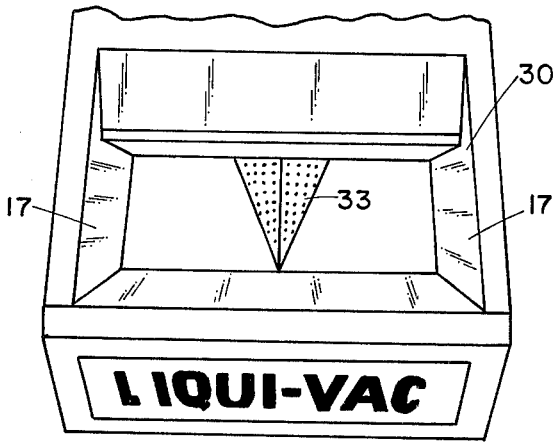
FIG. 3 is a top view of the cleaner housing with the top cover removed showing the used cleaning fluid recovery chamber.
Figure 4:
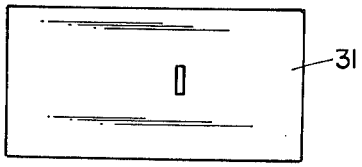
FIG. 4 is a top view of the removable filter elements which are to be placed in the bottom of the used cleaning fluid chamber shown in FIG. 3.

A large area filtering system is used to filter the used cleaning fluid before it enters pump 37. In the preferred embodiment, the bottom of used cleaning fluid chamber 30 shown in FIG. 3 is covered by filter 31, horizontal screen 32 (both shown in FIG. 4), and "V" screen 33 (shown in FIG. 3) so as to filter cleaning fluid discharge to prevent system clogging, etc. "V" screen 33 is rigidly attached to first partition 13 and projects upwardly from the sloping floor 13b of recovery chamber 30. Filter 31 and screen 32 are stacked on top of "V" screen 33, spaced above chamber bottom 13b and above the outlet to pump tube 38, as shown in FIG. 2.

Filter 31 and screen 32 conform to the shape of chamber 30 thereby covering as wide an area as possible. This wide area filter minimizes filter clogging problems. Preferably, the filter 31 is made of plastic sponge-like foam and screen 32 is a wire mesh screen.

FIG. 7 shows a vertical cross section of the fixture connector 70 which is generally an inverted "Y" configuration. The upper part of the inverted "Y" consists of a female connector joint 73 which is detachably connected to male connector joint 72. Female connector joint 73 is preferably attached to the plumbing fixture 74 by threading it into the discharge system of the fixture. The female connector 73 and male connector 72 preferably consist of a quick-connect type connection wherein attachment of the male connector joint 72 to female connector joint 73 is accomplished by insertion of the male connector joint 72 into the female connector joint 73. By so doing, the shrouding 75 of the female connector joint 73 is displaced upwardly causing water-tight contact of the connector joints. After such contact, the shrouding 75 slips over the ridges 76 of the male connector joint 72 to removably and securely attach the connector joints. The compartmentalized tubing 23 consists in the preferred embodiment of smaller diameter supply tube 27 housed within larger diameter discharge tube 29. The diameter differences are such that an adequate flow of discharged, used cleaning fluid is allowed. The male connector joint 72 is attached to supply tube 27 by means of a pinch washer 77 which is attached to the lower extension 78 of the connector joint. "Y" housing 79 is attached to discharge tube 29 and extends from around the discharge tube so as to form a holder for the male connector joint 72 which acts as a support for supply tube 27. The "Y" housing 79 in the preferred embodiment is threaded so that threaded male connector joint 72 can be readily attached to the housing. The housing 79 has a downwardly directed discharge exit 80 which is in communication with discharge tube 29 through lateral housing space 81 which is the open area between the walls of housing 79 and supply tube 27. The discharge tube 29 is attached on the housing 79 by threading connector 82 onto housing intake threads 83. The connector 82 allows rotation of its thread elements 84 without rotation of its discharge tube attachment elements 85 so as to allow rotation of the thread elements 84 to attach the connector 82 to the housing 79 without associated rotation of the discharge tube 29.

As the supply liquid flows through the male connector joint 72 and supply tubing 27, used cleaning fluid flows through the discharge tube 29 into the flow space 81 which surrounds the supply tube 27 and departs from the connector through discharge exit 80.

The "Y" connector 70a within control casing 20 is similar to "Y" connector 70, except for the absence of any quick disconnect feature.

OPERATION

In operation, the supply tube 25 and discharge tube 24, connect respectively with the handle 21 and via the compartmentalized tubing 23 to plumbing fixture 74. By means of electrical wiring (not shown), blower 50 and pump 37 are activated. Supply cut-off valve 28 is opened and the cleaning fluid begins to spray on the surface to be cleaned from nozzle 40. Adjustment valve 22 is used to control the flow of the additive into the cleaning fluid. In this preferred embodiment, the additive container 61 is transparent so as to enable the operator to control flow of the additive 62 into the cleaning fluid by visually regulating air bubble 63 flow into the additive container 61. The device is pulled across the surface to be cleaned so that nozzle 3 and the depending edge of the front wall 11 remain in contact with the surface being cleaned. Cleaning agent is sprayed on the surface being cleaned as the apparatus is manually pulled in a rearward direction so that the sprayed liquid loosens and picks up dirt and then is immediately sucked into nozzle 3 before having a chance to settle into the carpet again. The used cleaning fluid is drawn upwardly in the direction of the air flow through suction nozzle 3 and into the used cleaning fluid chamber 30 where the air and water separates. The air enters the compartment 35 and is discharged from the housing by the impeller 51, while the water is removed by pump 37 through the compartmentalized tubing 23 through the "Y" connector 70 to the sink 71.

The first baffle 15a on molded plastic top cover 15 causes an abrupt downward change of air flow from the section nozzle 3 so as to cause separation of used cleaning fluid and air and prevent liquid from being sucked directly through passageway 18. The planar surface 15c on the baffle top cover 15 in conjunction with the horizontal surface 15b and shield 16 causes a decrease in area flow space available to the air being drawn out from the chamber 30. This further channeling of air flow aided by screen 36 effectively completes the separation of air from the cleaning fluid, particularly its associated foam.

It will be understood that various changes in the details, materials, steps, and arrangement of parts, which have been herein described and illustrated in order to explain the nature of the invention, may be made by those skilled in the art within the principle and scope of the invention as described in the appended claims.

The embodiments of the invention in which an exclusive property or privilege is claimed are defined as follows:

1. A portable surface cleaning apparatus comprising: a housing defining a used cleaning fluid recovery chamber having front and rear walls and an open top; means on said housing for facilitating movement of said housing over the surface to be cleaned; a surface engaging suction nozzle on said housing in front of and adjacent said front wall of said recovery chamber, and opening into the top of said recoverry chamber, through which used cleaning fluid is drawn into said recovery chamber; a passageway generally at the rear of said recovery chamber and including an opening through the rear wall of said recovery chamber; blower means located in the rear of said housing adjacent and behind said recovery chamber rear wall and in flow communication with said recovery chamber through said passageway and said opening for effecting the rapid evacuation of air from said recovery chamber, causing a large volume of air and used cleaning fluid to be drawn through said suction nozzle; a shield extending upwardly from the bottom of said recovery chamber generally to the top thereof, said shield being located in front of and spaced from said rear wall and from said blower means; a cover on said recovery chamber, said cover including a raised portion located generally above said shield to define a space between the top of said shield and said cover, said space defining a portion of said passageway; said cover including a downwardly depending portion defining a first baffle at the top of said recovery chamber, adjacent and to the rear of said opening of said suction nozzle into said recovery chamber whereby air and used cleaning fluid being drawn through said nozzle and into said recovery chamber are directed downwardly into said recovery chamber by said first baffle.

2. A portable surface cleaning apparatus comprising: a housing defining a used cleaning fluid recovery chamber having front and rear walls and an open top; means on said housing for facilitating movement of said housing over the surface to be cleaned; a surface engaging suction nozzle on said housing in front of said front wall and opening into the top of said recovery chamber through which used cleaning fluid is drawn into said recovery chamber; a passageway generally at the rear of said recovery chamber and including an opening through said rear wall of said recovery chamber; blower means in flow communication with said recovery chamber through said passageway and said opening for effecting the rapid evacuation of air from said recovery chamber, causing a large volume of air and used cleaning fluid to be drawn through said suction nozzle; said blower means being positioned behind said rear wall of said recovery chamber within said housing; a shield extending upwardly from the bottom of said recovery chamber in front of and spaced from said rear wall and from said blower means for preventing liquid from being drawn into said blower means; a first baffle at the top of said recovery chamber, adjacent and to the rear of said opening of said suction nozzle into said recovery chamber whereby air and used cleaning fluid being drawn through said nozzle and into said recovery chamber are directed downwardly into said recovery chamber by said first baffle; a second baffle arching over said shield and downwardly in front of said shield to further define said passageway, and passageway, said passageway progressively decreasing in flow area as it approaches the top of said shield from the front whereby said shield blocks the flow of used cleaning fluid and suds through said passageway, over the top of said shield.

3. The apparatus of claim 2 including a molded cover for said recovery chamber; said cover being molded to a configuration defining said first and second baffles.

4. The apparatus of claim 1 in which said cover is a molded plastic cover; said downwardly depending portion of said cover blending into said upwardly raised portion of said cover.

5. The apparatus of claim 1 comprising: pump means positioned within said housing adjacent said recovery chamber and in flow communication with said recovery chamber for pumping liquid and suds out of said recovery chamber; a conduit operably connected to said pump means through which liquid and suds can be pumped to a discharge point remote from said housing.

6. The apparatus of claim 2 comprising: pump means positioned within said housing adjacent said recovery chamber and in flow communication with said recovery chamber for pumping liquid and suds out of said recovery chamber; a conduit operably connected to said pump means through which liquid and suds can be pumped to a discharge point remote from said housing.

7. A portable surface cleaning apparatus comprising: a housing defining a used cleaning fluid recovery chamber having front and rear walls and an open top; means on said housing for facilitating said housing over the surface to be cleaned; a suction nozzle on said housing adjacent said front wall of and opening into the top of said recovery chamber; a passageway generally at the rear of said recovery chamber and including an opening through said rear wall of said recovery chamber; blower means positioned within said housing at the rear of said recovery chamber behind said rear wall of said recovery chamber and in flow communication with said recovery chamber through said passageway and said opening for effecting the rapid evacuation of air from said recovery chamber, causing a large volume of air and used cleaning fluid to be drawn through said suction nozzle; a shield extending upwardly from the bottom of said recovery chamber in front of and spaced from said rear wall and from said blower means for preventing liquid from being drawn into said blower means; pump means positioned within said housing adjacent said recovery chamber and in flow communication with said recovery chamber for pumping liquid and suds out of said recovery chamber; a conduit operably connected to said pump means through which liquid and suds can be pumped to a discharge point remote from said housing; a cover removeably mounted on the top of said housing over the open top of said recovery chamber, said cover defining a first baffle at the top of said recovery chamber, adjacent and to the rear of said opening of said suction nozzle into said recovery chamber whereby air and used cleaning fluid being drawn through said nozzle and into said recovery chamber are directed downwardly into said recovery chamber by said first baffle.

8. The apparatus of claim 7 in which said cover is a molded plastic cover; said downwardly depending portion of said cover blending into said upwardly raised portion of said cover.

* * * * *

UNITED STATES PATENT AND TRADEMARK OFFICE

CERTIFICATE OF CORRECTION

PATENT NO. : 3,939,527

DATED : February 24, 1976

INVENTOR(S) : Terry H. Jones

It is certified that error appears in the above-identified patent and that said Letters Patent are hereby corrected as shown below:

Column 1, line 48;
"one" should be --One--;
Column 1, line 56;
After "that" insert --the--;
Column 2, line 3;
After "soap" insert --solution--;
Column 2, line 10;
"Invenntion" should be --Invention--;
Column 7, line 68;
"recoverry" should be --recovery--;
Column 8, line 56;
"and passageway," should be omitted;
Column 9, line 18;
After "facilitating" please add --movement of--.

Signed and Sealed this

*eighth* Day of *June 1976*

[SEAL]

*Attest:*

RUTH C. MASON
*Attesting Officer*

C. MARSHALL DANN
*Commissioner of Patents and Trademarks*